United States Patent [19]

Roper

[11] Patent Number: 4,766,923

[45] Date of Patent: Aug. 30, 1988

[54] FREEZE SAFE VALVE

[76] Inventor: Bernarr G. Roper, 1528 N. 1450 West, Provo, Utah 84604

[21] Appl. No.: 933,048

[22] Filed: Nov. 20, 1986

[51] Int. Cl.[4] ..... F16K 17/36

[52] U.S. Cl. ..... 137/15; 137/62; 137/599.2; 411/373; 411/395

[58] Field of Search ..... 137/599.2, 59, 60, 301, 137/457, 67, 467, 62, 15; 138/27, 28; 220/209, DIG. 19; 411/14, 373, 377, 395

[56] References Cited

U.S. PATENT DOCUMENTS

| | | | |
|---|---|---|---|
| 539,714 | 5/1895 | Walther et al. | 137/599.2 X |
| 668,355 | 2/1901 | Osgood | 137/599.2 X |
| 685,169 | 10/1901 | Paul | 137/599.2 X |
| 1,527,358 | 2/1925 | Hamilton | 137/599.2 X |
| 2,321,095 | 6/1943 | Mantz | 137/599.2 X |
| 2,518,827 | 8/1950 | Smith | 137/27 |
| 4,182,356 | 1/1980 | Woodford | 137/599.2 X |

FOREIGN PATENT DOCUMENTS

| | | | |
|---|---|---|---|
| 711080 | 6/1954 | United Kingdom | 137/67 |

*Primary Examiner*—Martin P. Schwadron
*Assistant Examiner*—Stephen M. Hepperle
*Attorney, Agent, or Firm*—Trask, Britt & Rossa

[57] ABSTRACT

A freeze safe valve has a valve body, a valve gate, a washer, a fastener having an interior channel, and a plug placed in the channel of the fastener. With fluid pressure in the normal downstream direction, the plug will be held in place, and the valve will function as a standard valve. However, when net pressure exists in the upstream direction at a certain predetermined level due to, for example, the formation of ice on the downstream side of the valve, the plug will become dislodged so that fluid may flow back to the upstream side. This will alleviate the pressure on the downstream side and ideally will preclude breakage of the downstream pipe or the valve itself.

5 Claims, 3 Drawing Sheets

FREEZE SAFE VALVE

BACKGROUND OF THE INVENTION

1. Field:

This invention relates to fluid valves and more particularly to fluid valves that have pressure relief means for relieving pressure from the downstream side of the valve to the upstream side.

2. State of the Art:

In cold climates, water that remains in outside water faucet pipes will occasionally freeze, sometimes causing breakage of the pipes. To rectify this problem there are freeze valves in which the faucet opening or spigot is outside the structure or house (e.g.), but the valve seat/-gate arrangement is located within. An outside handle opens or closes the valve by means of a rod connecting the handle to the valve.

Ideally, with this arrangement, any water remaining in the pipe on the downstream side of the valve seat/-gate arrangement will drain from the valve through the outside spigot. The water on the upstream side of the valve will ideally be located sufficiently within the outer wall of the structure to be kept fluid (avoid freezing) by the normal heat within the structure.

Occasionally, however, the water in the downstream portion of the pipe will not drain out of the spigot. For example, if a hose is connected to the spigot on the outside of the structure, or if the pipe has an upward slope, water may remain in the downstream pipe. Water may then freeze in the pipe and break the pipe and/or the valve. Serious flooding and damage may then occur.

SUMMARY OF THE INVENTION

A valve with a pressure relief means is intended for use in fluid systems having normally unidirectional flow. Specifically, when the valve is closed, the pressure relief means is designed to alleviate pressure that may develop downstream, due to, for example, the formation of ice. The pressure relief means functions by allowing pressurized fluid on the downstream side of the valve to flow back through the closed valve to the upstream side.

The valve includes a valve body for connection in a fluid system such as a plumbing system. A valve seat is positioned within the valve body, and a value gate is operatively positionable against the seat for restricting fluid flow past the gate.

A channel is formed in the valve gate to allow fluid intercommunication between the upstream and downstream sides of the gate means. A plug is positioned in the channel to preclude fluid from flowing from the upstream side of the valve gate to the downstream side. However, when the fluid pressure on the downstream side exceeds that of the upstream side by a preselected amount, the plug no longer seals the channel and fluid may flow from the downstream side to the upstream side.

A washer screw may be adapted to be a pressure relief mechanism to function in a valve of the invention. Such a washer screw is a common machine screw with threads along the length of the body and a head for receiving a screwdriver.

A first cylindrical bore is formed beginning at the head of the screw and going along its longitudinal axis. A second cylindrical bore coaxial to the first bore, is formed at the other end of the screw and connects with the first bore. The connection between the two bores forms a flat annular shoulder. The two bores form a channel from one end of the screw to the other.

This screw is used to hold a valve washer connected to the flat annular face of a valve gate. When the screw washer is in place, the valve gate and washer may be positioned against a smooth annular orifice forming a valve seat. The valve gate and washer serve to restrict fluid flow past the valve gate.

The channel in the washer screw connects the downstream and upstream sides of the valve gate to provide fluid intercommunication between the two sides. A cylindrical plug of substantially the same diameter as the first cylindrical bore is sealably and snugly placed in the first bore and abutting against the annular shoulder.

When fluid pressure on the upstream side exceeds that of the downstream side, the plug remains in place. However, when the fluid pressure on the downstream side exceeds that of the upstream side by a certain preselected amount, the plug is dislodged and fluid may pass from the downstream side to the upstream side, thus relieving built-up pressure on the downstream side.

BRIEF DESCRIPTION OF THE DRAWINGS

In the drawings, which illustrate what is currently regarded as the best mode for practicing the invention.

DETAILED DESCRIPTION OF THE DRAWINGS

Figure 1:
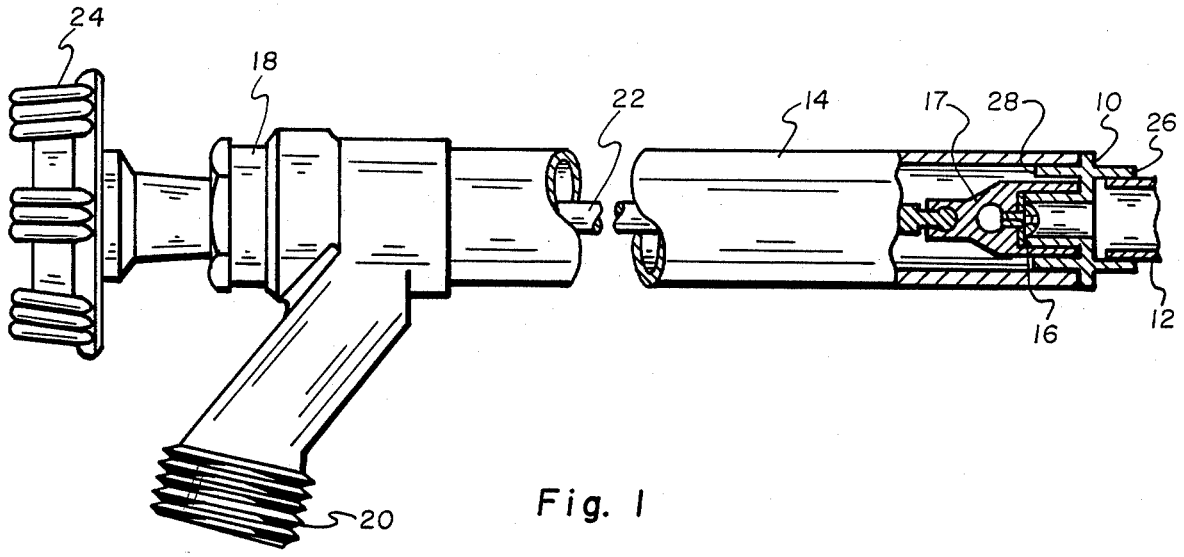
FIG. 1 is a cross-sectional view of a freeze valve of the invention.

Referring to FIG. 1, a freeze valve of the invention comprises a valve body 10, an upstream pipe 12, a downstream pipe 14, a valve seat 16, a valve gate 17, a seal 18, a spigot 20, a rod 22, and a handle 24. The valve body 10 has an inlet 26 and an outlet 28. The normal direction of fluid flow is in the direction from the upstream pipe 12, through the valve body 10 and into the downstream pipe 14.

The valve body 10 connects to the upstream pipe 12 at the inlet 26 of the valve body by, for example, a conventional solder connection. The valve body 10 connects to the downstream pipe 14 at the outlet 28 of the valve body 10. The valve seat 16 is housed within and connected to the valve body 10. The valve gate 17 operates against the valve seat 16 to restrict fluid flow past the valve gate 17. As fluid flows in its normal direction from the valve body 10 toward the spigot 20, fluid is precluded from leaving the end of the pipe 14 by the seal 18. Fluid therefore exits through the spigot 20.

The valve gate 17 is connected to the remote handle 24 by means of the rod 22. The rod 22 is firmly connected to the valve gate 17 and passes through the downstream pipe and through a watertight channel (not shown) in the seal 18. The rod 22 then connects to the handle 24 on the outside of the downstream pipe 14. The handle 24 may be rotated to operate (i.e., open or close) the valve gate 17.

Figure 2:
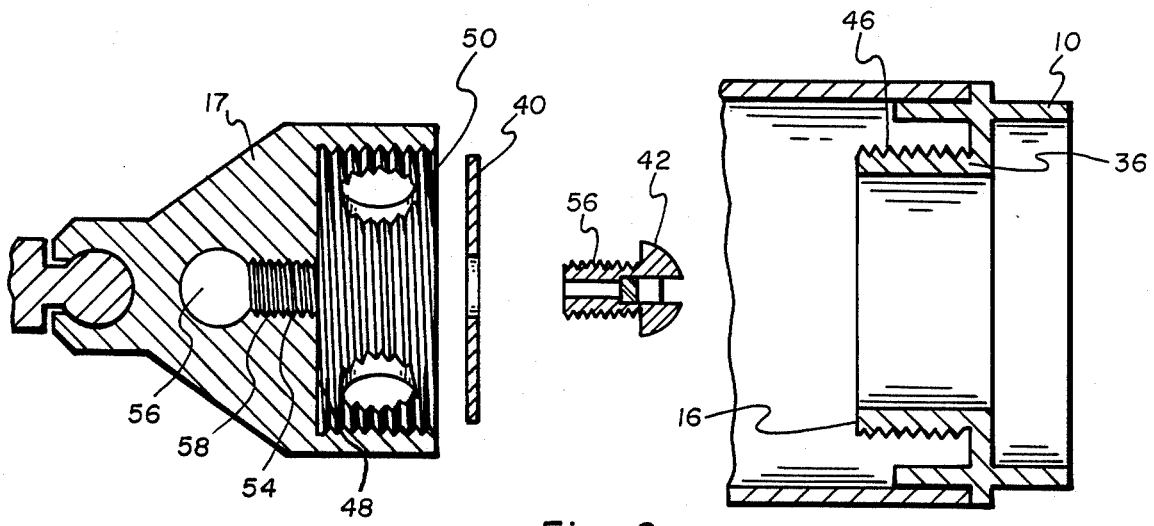
FIG. 2 is a cross-sectional view of a valve of the invention.

Referring to FIG. 2, the freeze valve further comprises a valve seat support 36, a washer 40, and a washer screw 42. Connected to and within the valve body 10 is the valve seat support 36, which contains exterior threads 46 and the valve seat 16. The valve seat 16 is a smooth, annular surface.

Figure 3:
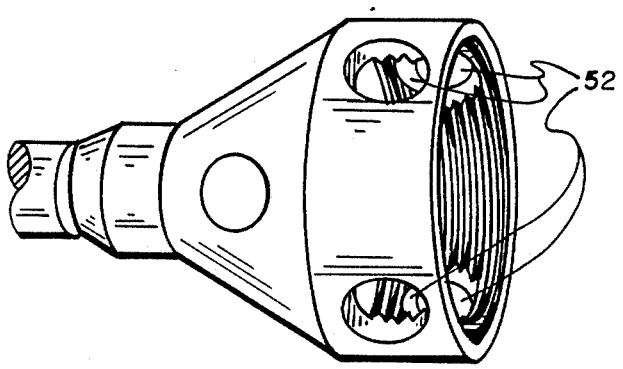
FIG. 3 is a perspective view of the valve gate of FIG. 2.

The valve gate 17 contains a flat annular valve gate face 48, interior threads 50, a plurality of channels 52 (FIG. 3), a channel 54, and a channel 56. The valve gate face 48 is formed to be sufficiently parallel to the surface of the valve seat 16 so that a fluid tight seal can be effected with use of a annular rubber washer 40 that is placed against the valve gate face 48. The washer screw 42 is threaded into the channel 54 by means of the threads 56 of the washer screw interlocking with the threads 58 of the valve gate 17. The washer screw 42 serves to firmly attach the washer 40 to the valve gate face 48. The threads 50 of the valve gate 17 interlock with the threads 46 of the valve seat support 36. With this arrangement, the valve gate 17 may be turned with respect to the valve seat support to bias the valve gate face 48 and the washer 40 toward or away from the valve seat 16.

The valve body 10, valve seat support 36, valve seat 16, valve gate 17, washer screw 42, rod 22, and spigot 20 are preferably made of a suitable non-corroding material such as brass. It may also be possible for these components to be made, for example, of stainless steel, plastic, aluminum, or ceramic. The conduit comprising the upstream pipe 12 and downstream pipe 14 may be made of available materials common in the plumbing industry, such as copper pipe or PVC tubing. The water tight seal (not shown) in seal 18 is preferably a brass bushing, but may also be formed in other ways common in the art. The handle 24 may be made of inexpensive but durable material, preferably plastic or aluminum, but may be also made of other available durable materials.

Figure 4:
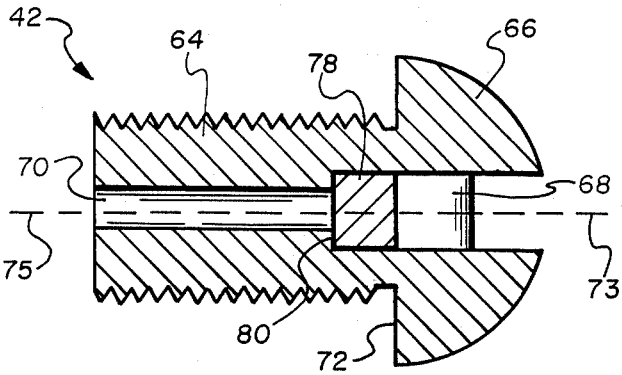
FIG. 4 is a cross-sectional view of a pressure relief assembly of the invention.
Figure 5:
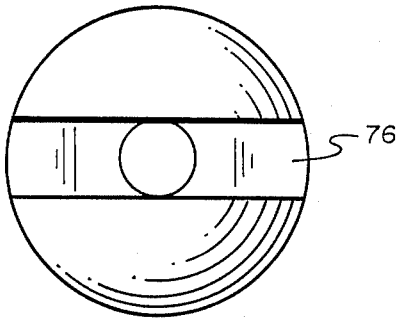
FIG. 5 is an end view of the pressure relief assembly of FIG. 4.

Referring to FIG. 4, the washer screw 42 is comprised of a body 64, a head 66, a cylindrical bore 68, a cylindrical bore 70, and slot 76 (FIG. 5). The slot 76 is sized to receive a standard screw driver. A cylindrically shaped plug 78 is positioned within the cylindrical bore 68.

The cylindrical bore 68 connects with cylindrical bore 70, having a smaller diameter than the bore 68. The two bores, 68 and 70, each have central axis 73, 75 which are here shown to be coaxial. The two bores 68 and 70 constitute a channel through which fluid may flow from one end of the screw 42 to the other. The junction of the bores 68 and 70 constitutes a flat annular shoulder 80.

The cylindrical plug 78 has a smooth cylindrical surface having a diameter substantially the same as the bore 68. The plug 78 is lodged in the bore 68 to abut the annular shoulder 80. The plug 78 is sized so that when it is lodged in the bore 68, fluid is precluded from flowing through the channel formed by the bores 68 and 70.

The plug 78 will become dislodged from the bore 68 only when the fluid pressure on the downstream side of the pressure relief assembly is greater than on the upstream side, and the pressure differential between the downstream and upstream side has reached a certain preselected pressure amount.

In the preferred embodiment of the invention, the cylindrical bore 68 has approximately a 5/64" diameter, and the cylindrical bore 70 has approximately a 1/64" diameter. The plug is desirably made of plastic and is slightly compressible to provide a tight sealing fit when positioned in the bore 68. However, other embodiments of the invention are possible, depending on the desired pressure differential and other desired characteristics. For example, the plug may be formed of smooth metal, which would associate with a smooth surface in the inside of bore 68. Such a metal plug may have a wax coating or other sealing material positioned thereon to alter the frictional characteristics between the plug and bore and to provide for a tight seal. Or the plug itself might be formed of wax.

Figure 6:
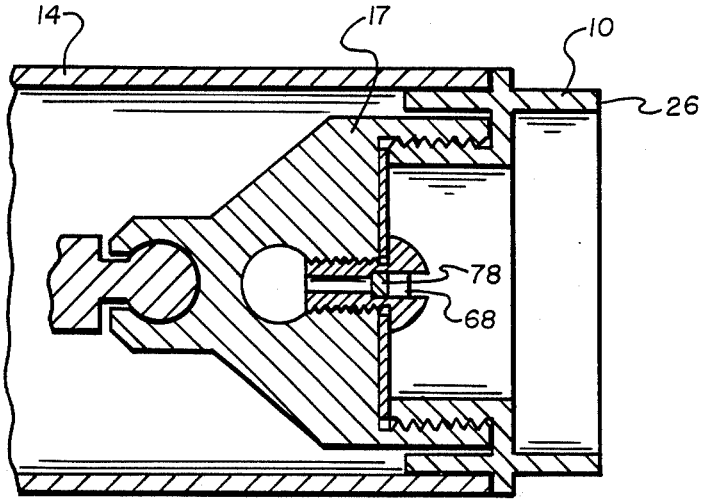
FIG. 6 is a cross-sectional view of a valve of the invention in a closed position.

FIG. 6 depicts the valve gate 17 in a closed position within the valve body 10. With the valve gate 17 in the closed position, and the plug 78 contained within the channel 68, fluid is precluded from flowing from the inlet 26 past valve gate 17 and to the downstream pipe 14.

Figure 7:
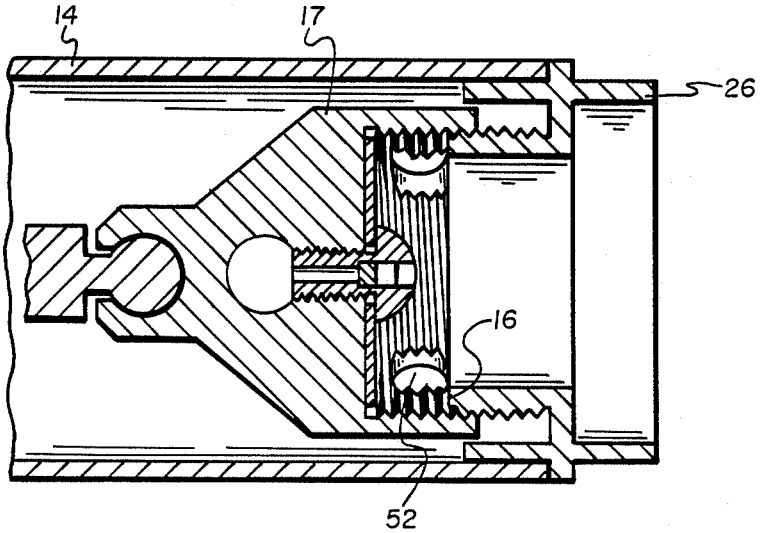
FIG. 7 is a cross-sectional view of a valve of the invention, in an open position.

FIG. 7 depicts the valve gate 17 in an open position. With the valve gate 17 in an open position, fluid may flow from the inlet 26 through the valve seat 16, through the plurality of channels 52, and finally into the downstream pipe 14.

Figure 8:
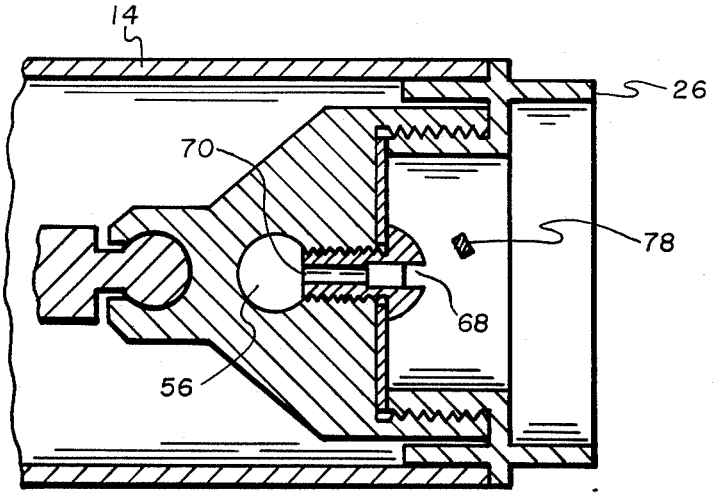
FIG. 8 is a cross-sectional view of a valve of the invention, in a closed position, with the pressure relief assembly open.

Referring to FIG. 6 and 7, with the plug 78 lodged in the bore 68 the regulatory assembly functions in its normal way as described in the two preceding paragraphs. However, with the plug 78 dislodged from the bore 68 as depicted in FIG. 8 fluid may flow through the channel formed by the cylindrical bores 68 and 70. Flowing in the upstream direction, fluid would flow from the downstream pipe 14, through the channel 56, into the bore 70, into the bore 68 and toward the inlet 26.

Figure 9:
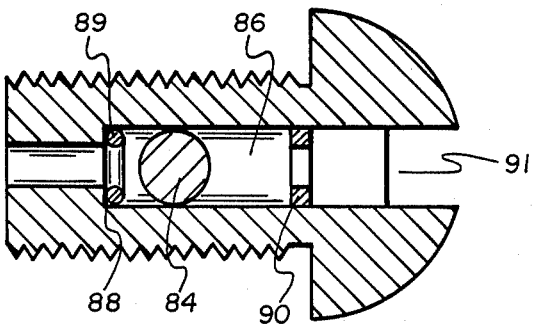
FIG. 9 is a cross-sectional view of another embodiment of a pressure relief assembly of the invention.

Another embodiment of the pressure relief assembly of the invention is disclosed in FIG. 9, in which the plug 78 is replaced by a spherical ball 84 having a smaller diameter than the bore 86. When the fluid pressure is greater on the upstream side the ball is pressed against the rubber O ring 88 and fluid is precluded from flowing in the downstream direction. When fluid pressure is greater on the downstream side, the ball 84 moves away from the O ring 88 and fluid may flow in the upstream direction. The retaining ring 90 keeps the ball from leaving the bore 86. The retaining ring 90 is a brass washer that is force fit into the bore 91 as illustrated.

The ball 84 may be made of a hard element such as hard plastic or metal. Or the ball may be made of a softer plastic or rubber, in which case, the O ring may be dispensed with, since with a softer element, the ball 88 might serve as an effective seal against the annular shoulder 89.

Figure 10:
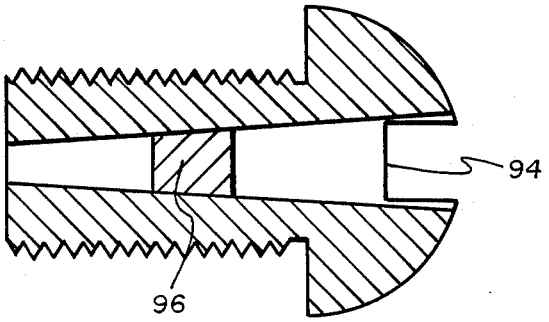
FIG. 10 is a cross-sectional view of another embodiment of a pressure relief assembly of the invention.

FIG. 10 discloses another embodiment of a washer screw of the invention. The bores 68 and 70 are replaced by a single conical bore 94. A truncated conical shaped plug 96 is wedged in the bore 94 and functions the same as the plug 78. As with the plug 78, the plug 94 may be made of plastic or other element having the desired properties.

It should be noted that the screw 42 here interconnects with preformed apertures already existing in valves which are known as Woodward valves, Prieve valves and Mansfield valves. For models not having such apertures, the channel 70 must be extended from the screw 42 through the gate body to interconnect with the downstream fluid stream.

As noted, water trapped in the valve may freeze. The exterior portion will freeze first because it is subject to the lower temperatures. As the water freezes, it expands into ice causing the water trapped between the ice and the valve seat to increase in pressure (water being essentially non-compressible). Upon the pressure downstream increasing to a differential pressure from about 1 to 10 pounds per square inch, the plug 78 is urged upstream relieving the pressure and avoiding a break in the pipe or in the valve seat structure. Upon a thaw, the valve will notably drip or lightly leak alerting one to repair by replacing the screw or the plug.

The embodiment depicted in FIG. 9, however, is designed to avoid the necessity of the user having to "re-set" the pressure relief assembly. As shown, the ball will not leave the pressure relief assembly. Thus, when the downstream back pressure no longer exists, the embodiment of FIG. 9 "re-sets" itself.

It is to be understood that the embodiments of the invention above described are merely illustrative of an application of the principles of the invention. Reference herein to details of the illustrated embodiment is not intended to limit the scope of the claims which themselves recite those features regarded as essential to the invention.

I claim:

1. A fluid valve, comprising:

a valve body;

a valve seat positioned within said valve body;

a valve gate sized to fit within said body for operatively positioning against said valve seat in a closed position to restrict fluid flow, said valve gate having an upstream and a downstream side;

a washer screw configured and adapted to be removably coupled to said valve gate and having a channel formed therein for providing fluid intercommunication between said downstream and said upstream sides with said valve gate in a closed position, said channel having a first portion in communication with said upstream side and a second portion in communication with said first portion and said downstream side, said first portion having a greater cross sectional area than said second portion wherein said first and second portions are sized and shaped to form a shoulder therebetween; and a resilient plug sized and shaped to snugly be positioned in an interference fit in said first portion of said channel to abut said shoulder to restrict the flow of fluid through said channel from said upstream side to said downstream side, said plug being moveable to be dislodged upstream of said first portion with said valve gate in said closed position to pass fluid from said downstream side to said upstream side when the fluid pressure on said downstream side exceeds the fluid pressure on said upstream side a certain preselected amount.

2. The fluid valve of claim 1, wherein said first portion is a first bore formed to be substantially circular in cross-section, and wherein said second portion is a second bore formed to be substantially circular in cross-section, and wherein said first bore and said second bore are coaxial and sized to form a flat annular shoulder therebetween, said plug being sized to snugly fit within said first bore and against said shoulder.

3. A freeze resistant valve for use in a plumbing system, said freeze resistant valve being formed to extend and pass freezable fluids through a structure from interior to exterior thereof, said freeze valve comprising:

a valve body having an elongated conduit portion sized to extend through a structure from interior to exterior of said structure;

a valve seat positioned within said valve body proximate the interior of said structure;

a valve gate positioned with said valve body for positioning against said valve seat to regulate fluid flow between an upstream side and downstream side of said valve gate, said valve gate being operative between an open and closed position;

a valve spigot positioned exterior said structure and connected to said valve body to pass fluid from said freeze resistant valve;

a valve rod connected to said valve gate for operation thereof, said valve rod being sized in cross section smaller than said valve body and being sized in length to extend therethrough toward the exterior of said structure and through said valve spigot;

handle means adapted to said valve rod for manual operation of said valve rod;

a washer screw removably coupled to said valve gate and having a channel formed therein to allow fluid intercommunication between said downstream and said upstream side with said gate means in a closed position, said channel having a first portion in communication with said upstream side and a second portion in communication with said first portion and said downstream side, said first section having a greater cross sectional area then said second portion wherein said first and second portions are sized and shaped to form a shoulder therebetween; and a resilient plug snugly positioned in an interference fit in said first portion of said channel to abut said shoulder to restrict the flow of fluid through said channel from said upstream side to said downstream side, said plug being moveable to be dislodged upstream of said first portion with said valve gate in said closed position to pass fluid from said downstream side to said upstream side when the fluid pressure on said downstream side exceeds the fluid pressure on said upstream side at a certain preselected amount.

4. The freeze resistant valve of claim 3, wherein said first portion is a first bore formed to be substantially circular in cross section, and wherein said first bore and said second bore are coaxial and sized to form a flat annular shoulder therebetween, said plug being sized to snugly fit within said first bore and against said shoulder.

5. A method for constructing a pressure relief assembly for use in a fluid valve, wherein said fluid valve has a washer screw that holds a valve washer against a valve gate, and wherein said valve gate has an upstream and a downstream side and a threaded bore for receiving said washer screw, said threaded bore allowing fluid intercommunication between said upstream and said downstream sides, said method comprising:

forming a channel in said washer screw, said channel being positioned so as to allow fluid intercommunication between said upstream and said downstream side, said channel having a first and second portion, said first portion being in communication with said upstream side, and said second portion connecting with said first portion at a shoulder and said downstream side, and said first portion having a cross-sectional area greater than said second portion;

positioning a resilient plug in said first portion, said plug being sized to snugly fit in an interference fit within said first portion and abutting said shoulder to be dislodged upstream of said washer screw when fluid pressure on said downstream side exceeds the fluid pressure on said upstream side a certain preselected amount.

* * * * *